US005548220A

United States Patent [19]

Kawamoto et al.

[11] Patent Number: 5,548,220

[45] Date of Patent: Aug. 20, 1996

[54] APPARATUS FOR DETECTING MISFIRE IN INTERNAL COMBUSTION ENGINE

[75] Inventors: Atsunobu Kawamoto; Yukio Yasuda, both of Itami, Japan

[73] Assignee: Mitsubishi Denki Kabushiki Kaisha, Tokyo, Japan

[21] Appl. No.: 433,755

[22] Filed: May 4, 1995

[30] Foreign Application Priority Data

Nov. 8, 1994 [JP] Japan ..... 6-273990

[51] Int. Cl.[6] ..... F02P 17/00

[52] U.S. Cl. ..... 324/399; 324/378; 73/116; 123/479

[58] Field of Search ..... 324/378, 380, 324/382, 388, 393, 399; 123/479, 427, 644; 73/116

[56] References Cited

U.S. PATENT DOCUMENTS

| | | | |
|---|---|---|---|
| 4,742,306 | 5/1988 | Everett et al. | 324/388 |
| 5,019,779 | 5/1991 | Ookawa | 324/388 |
| 5,027,073 | 6/1991 | Kaller et al. | 324/399 |
| 5,045,796 | 9/1991 | Bentel | 324/388 |
| 5,237,279 | 8/1993 | Shimasaki | 324/399 |
| 5,283,527 | 2/1994 | DeBiasi | 324/388 |
| 5,294,887 | 3/1994 | Etzold | 324/388 |
| 5,299,543 | 4/1994 | Taruya et al. | 324/388 |
| 5,334,938 | 8/1994 | Kugler et al. | 324/399 |
| 5,396,176 | 3/1995 | Ishii et al. | 324/388 |
| 5,483,818 | 1/1996 | Brandt et al. | 324/399 |

*Primary Examiner*—Sandra L. O'Shea
*Assistant Examiner*—Raymond Y. Mah
*Attorney, Agent, or Firm*—Leydig, Voit & Mayer

[57] ABSTRACT

An apparatus for detecting a misfire in an internal combustion engine that is capable of preventing erroneous detection in a period in which the discharged voltage on a secondary ignition coil is charged. The apparatus having a capacitor, which is supplied with bias voltage from a primary side of an ignition coil to be electrically charged to apply the charged voltage to the spark plug at the time of discharge of the spark plug to cause an ionic current to flow and a misfire detection circuit for determining whether or not a misfire has taken place in accordance with detection of the ionic current flowing from the capacitor. The apparatus for detecting a misfire in an internal combustion engine includes a discharge-period detecting Zener diode disposed between another end of the primary coil and an inverting input terminal of an operational amplifier, having Zener voltage lower than the Zener voltage of a Zener diode, which sets voltage to be charged into the capacitor, and connected in a direction in which an electric current flowing while exceeding the Zener voltage is caused to flow toward the inverting input terminal of the operational amplifier.

9 Claims, 7 Drawing Sheets

| A | B | OUT |
|---|---|---|
| L | L | H |
| L | H | H |
| H | L | L |
| H | H | H |

APPARATUS FOR DETECTING MISFIRE IN INTERNAL COMBUSTION ENGINE

BACKGROUND OF THE INVENTION

1. Field of the Invention

This invention relates to an apparatus for detecting a misfire in an internal combustion engine by detecting an ionic current which flows in a spark plug disposed in a combustion chamber of the internal combustion engine.

2. Description of the Related Art

In an internal combustion engine, a mixture of fuel and air is compressed and the mixture is ignited by an electric spark generated due to application of high voltage to a spark plug disposed in the combustion chamber. A state where the mixture is not ignited is called "misfire". In the foregoing case, a satisfactory output from the internal combustion engine cannot be obtained. In addition, the mixture containing fuel in a large quantity is introduced into the exhaust system, thus raising a problem in that the muffler and the like are corroded by the mixture. Therefore, misfires must be detected in order to issue an alarm to a driver.

As an apparatus for detecting a misfire in an internal combustion engine, a circuit has been available which detects a misfire by detecting an ionic current which flows in a spark plug disposed in the combustion chamber. When combustion takes place in the combustion chamber, molecules in the combustion chamber are ionized. When voltage is, through the spark plug, applied into the combustion chamber which is in the ionized state, a small electric current flows, which is called an "ionic current". Since the ionic current is greatly diminished if a misfire takes place, occurrence of the misfire can be discriminated by detecting this change in ionic current.

FIG. 7 illustrates a conventional apparatus of the foregoing type for detecting a misfire in an internal combustion engine which has been disclosed in, for example Japanese Patent Laid-Open No. 4-191465.

Referring to FIG. 7, reference numeral 1 represents an ignition coil, 1*a* and 1*b* respectively represent a primary coil and a secondary coil of the ignition coil 1, 2 represents a spark plug disposed in a combustion chamber 20, the spark plug 2 being connected to the negative terminal of the secondary coil 1*b*. The primary coil 1*a* has a positive terminal connected to a power source 4 and a negative terminal connected to the collector of a transistor 5 which switches the electric current. The emitter of the transistor 5 is connected to ground and the base of the transistors is controlled by a control unit (not shown) which controls combustion.

Reference numeral 8 represents a misfire detection circuit, 9 represents a capacitor connected to the positive terminal of the secondary coil 1*b*, 10 represents a Zener diode connected between the positive terminal of the secondary coil 1*b* and ground to set the voltage for charging into the capacitor 9, and 11 represents a diode connected such that its portion adjacent to the capacitor 9 is the anode thereof, the diode 11 being connected between the low potential side of the capacitor 9 and ground. Reference numeral 12 represents a resistor.

In the circuit having the foregoing structure, the control unit (not shown), at the ignition timing for the internal combustion engine, performs control so that the transistor 5, which has been turned on, is rapidly turned off. At this time, the primary current flowing in the ignition coil 1 is rapidly decreased and, thus, the counter electromotive force of the coil generates high voltage. The voltage generated on the primary side is amplified in accordance with the coil ratio between the primary coil 1*a* and the secondary coil 1*b*, the amplified voltage appearing on the secondary side of the ignition coil 1. As a result, the spark plug 2 is applied with voltage of, for example, about −10 KV to about −25 KV.

In the circuit shown in FIG. 7, energy at the ignition timing is used to accumulate charges in the capacitor 9, the charges being sufficient to detect the ionic current. The voltage supplied from the capacitor 9 is used to detect the ionic current immediately after ignition. The electric current, at the ignition timing, flows in a direction indicated by an arrow 2*c* shown in FIG. 7, thus causing the spark plug 2 to discharge electricity. Thus, the mixture in the combustion chamber 20 is ignited. The discharge current charges the capacitor 9, and therefore, the capacitor 9 is charged to a voltage level limited by the Zener diode 10.

When the igniting electric current flowing in the direction indicated by the arrow 2*c* is decreased to zero, the voltage maintained in the capacitor 9 is applied to the spark plug 2. At this time, if combustion takes place normally in the combustion chamber 20, an ionic current flows through the resistor 12 in a direction indicated by an arrow 2*d*. Therefore, the resistor 12 causes the voltage to be lowered and lowering of the voltage is, as a detection signal, used to discriminate whether or not a misfire has taken place. If a misfire takes place, the flowing ionic current is greatly diminished and therefore substantially no voltage caused from this appears as the output.

The apparatus for detecting a misfire in an internal combustion engine has a problem in that the misfire detection involves an error due to stray capacitance and the like, as will be described subsequently.

That is, the misfire detection circuit is, together with an ignition coil and the like, disposed in the engine compartment of an automobile in a variety of methods depending upon the structure of the engine or the like. For example, the length from the ignition coil 1 to the spark plug 2 shown in FIG. 7 is sometimes about 2 m in a case where it is long. If the length of wiring is long, stray capacitance is generated between the foregoing wiring and another wiring, in particular, the ground, that has another potential.

Assuming that the stray capacitance with respect to the ground is Cf [F](farad) in a case of the circuit shown in FIG. 7, a series circuit consisting of the stray capacitance Cf, the capacitor 9 and the resistor 12 is formed. The operation of the series circuit is affected considerably by a charging/discharging time constant determined by the resistance value of each of the stray capacitance Cf and the resistor 12. In particular, a problem rises in that the time width of the noise signal is enlarged. Specifically, decaying of noise currents of 100 μsec (microsecond) and 10 mA (milliampere) to 1 μA (microampere) or smaller that is free from a problem as compared to the ionic current requires a time period of about 1 msec (millisecond) if the stray capacitance Cf is 500 pF (picofarad) and the resistor 12 is 200 KΩ (kilohm), thus causing the noise current waveform to be widened to about 10 times. Therefore, there rises a possibility that noise is erroneously detected as the ionic current.

To overcome the foregoing problem, it might be considered feasible to reduce the resistance value of the resistor 12 or to decrease the stray capacitance. If the resistance value is reduced, the sensitivity to detect a misfire is deteriorated, thus raising a problem in that detection cannot be performed in a low rotational region in which the ionic current is decreased. The decrease of the stray capacitance considerably limits the place in which the detection circuit is disposed and the method of the disposition.

In view of the foregoing, a circuit for detecting a misfire in an internal combustion engine has been suggested which is capable of preventing erroneous detection taking place due to the stray capacitance and the reliability of which can be improved (refer to Japanese Patent Application No. 6-8880 filed on Jan. 28, 1994).

FIG. 8 is a structural view showing a circuit equivalent to an apparatus for detecting a misfire in an internal combustion engine of the foregoing type that is capable of preventing erroneous detection.

Referring to FIG. 8, the same elements as those shown in FIG. 7 are given the same reference numerals and their description is omitted here.

Novel reference numerals will now be described. Reference numerals 2*a* and 2*b* represent spark plugs of a simultaneous-ignition type which produce electric sparks by using high voltage generated at the two electrodes of the secondary coil 1*b* of the ignition coil 1. Reference numeral 3 represents a voltage-resistible diode, the cathode of which is connected to the spark plug 2*b*, the anode of which is connected to the positive terminal of the capacitor 9 in the misfire detection circuit 8 and which detects an ionic current. The collector of the transistor 5 for switching the electric current is connected to the negative terminal of the primary coil 1*a* of the ignition coil 1 and as well as the capacitor 9 of the misfire detection circuit 8 is connected to the same through the resistor 6 and the high-voltage diode 7. Thus, positive bias voltage is applied to the capacitor 9 so that a charging current is supplied from the primary coil 1*a* of the ignition coil 1 through the resistor 6 and the high-voltage diode 7.

New reference numeral 13 represents a second diode as contrasted with the first diode which is the diode 11 having the anode connected to the low potential side of the capacitor 9 and the cathode connected to ground. The second diode 13 has a cathode connected to the low potential side of the capacitor 9 and an anode connected to the earth. Reference numeral 14 represents an operational amplifier (hereinafter called an "op-amplifier) having an inverting input connected to the anode of the diode 11 and a non-inverting input connected to ground, the operational amplifier 14 having a feedback resistor 15 connected between the inverting input and the output.

In a circuit structured as shown in FIG. 8, a control unit (not shown), at the ignition timing for the internal combustion engine, performs control so that the transistor 5, which has been turned on, is rapidly turned off. At this time, the primary current flowing in the ignition coil 1 is rapidly decreased and, thus, the counter electromotive force of the coil generates high voltage. The voltage generated on the primary side is amplified in accordance with the coil ratio between the primary coil 1*a* and the secondary coil 1*b*, the amplified voltage appearing on the secondary side of the ignition coil 1. As a result, the spark plug 2*a* is applied with negative voltage of, for example, about −10 KV to about −25 KV, while the ignition coil 2*b* is applied with positive voltage of, about 10 KV to 25 KV.

In the circuit shown in FIG. 8, the electric current flowing from the primary side of the ignition coil 1 to the capacitor 9 through the resistor 6 and the high-voltage diode 7 charges the capacitor 9 in a period in which high voltage is generated from the primary side of the ignition coil 1 due to the counter electromotive force, the capacitor 9 being charged to a voltage level (for example, the Zener voltage of the Zener diode 10: $V_Z$=50 V) which is limited by the Zener diode 10. Thus, charges sufficient to detect the ionic current are accumulated in the capacitor 9. In accordance with the voltage charged into the capacitor 9, the ionic current flowing through the secondary side of the ignition coil 1 is detected.

FIG. 9 shows the waveforms of portions S1 and S2 of the circuit shown in FIG. 8. The waveform S1 represents the base potential of the transistor 5 for controlling the electric current flowing in the primary coil 1*a* of the ignition coil 1 and S2 represents the negative terminal potential of the primary coil 1*a*.

The transistor 5 is turned on in an ON period in which the electric current is caused to flow in the primary coil 1*a* and turned off in an OFF period in which the electric current in the primary coil 1*a* is stopped. When the transistor 5, which has been turned on, is turned off, the counter electromotive force of the coil raises the voltage of S2, which is the negative terminal of the primary coil 1*a*, to $V_H$=about 300 V. The raised voltage is the same as the resistible voltage between the collector and the emitter of the transistor 5. In a period in which the counter electromotive force is generated, an electric current flows in the capacitor 9 through the resistor 6 and the diode 7. Thus, the capacitor 9 is charged to about Zener voltage $V_Z$ (for example, 50 V) which is limited by the Zener diode 10; and the voltage $V_2$ at the negative terminal S2 of the primary coil 1*a* of the ignition coil 1 is lowered to about the value of the Zener voltage $V_Z$, strictly the voltage $V_2$ being lowered to a value which is the result of addition of the voltage drop taking place due to the resistor 6 and the forward-directional voltage of the diode 7.

The high voltage $V_H$ generated at the primary coil 1*a* of the ignition coil 1 is amplified in accordance with the coil ratio between the primary coil 1*a* and the secondary coil 1*b* of the ignition coil 1, the high voltage $V_H$ being applied to the spark plug 2*a* connected to the negative terminal of the secondary coil 1*b* so that the spark plug 2*a* is ignited. The electric current, at the ignition timing, flows in a direction indicated by an arrow 2*c* so that a spark is generated by the spark plug 2*a* and discharge takes place. Thus, the mixture in the combustion chamber 20 is ignited. After the capacitor 9 has been charged completely, a state is realized in which the voltage accumulated in the capacitor 9 is applied to the spark plug 2*a*. If combustion is being performed in the combustion chamber 20 at this time, then an ionic current flows on the secondary side of the ignition coil 1 in a direction indicated by an arrow 2*d*.

The ionic current is, by the misfire detection circuit 8, converted into voltage. In accordance with whether or not the voltage obtained by the conversion exceeds a threshold, whether or not a misfire has taken place is discriminated. That is, if a misfire takes place, namely, if no combustion is performed, a very small electric current flows and, therefore, substantially no voltage due to this appears in the output. Note that the voltage at an end S2 of the primary coil 1*a* of the ignition coil 1 is gradually decreased after the capacitor 9 has discharged electric power to reach the battery voltage $V_{BAT}$ of the power source 4. When the transistor 5 is then controlled to be turned off, the voltage is made to be zero.

The voltage on the low potential side of the capacitor 9 is the voltage of the inverting input of the inverse amplifier composed of the foregoing operational amplifier 14 and the resistor 15. In a case where the operational amplifier 14 is operated normally, the inverting input voltage and the non-inverting input voltage are the same, thus, resulting in 0 V.

The case where the operational amplifier 14 is not performed normally is a case where the electric current flows in the direction indicated by the arrow 2*c* and a case where the electric current flowing in the direction indicated by the arrow 2*d* is too large and therefore the output from the operational amplifier 14 is saturated. In the case where the electric current flows in the direction indicated by the arrow 2*c*, that is, in a case where the capacitor 9 is in a charged state, the charging current flows from the primary coil 1*a* to the capacitor 9 through the resistor 6 and the diode 7, so that the voltage on the low potential side of the capacitor 9 is the forward-directional voltage (0.7 V) of the first diode 11. In the case where the electric current flowing in the direction indicated by the arrow 2*d* is too large and therefore the output from the operational amplifier 14 is saturated, the second diode 13 is made conductive. Thus, the voltage at the low potential side of the capacitor 9 is lowered by a degree corresponding to the forward-directional voltage. In a case where the operational amplifier 14 is operated normally, the ionic current appears as the voltage drop of the resistor 15 and is converted into a signal based on ground, the signal being transmitted.

By employing the foregoing circuit structure, the low-potential side of the capacitor 9 involves a small voltage change with respect to change in the electric current. If the operational amplifier 14 is normal, the apparent voltage on the low-potential side of the capacitor 9 is constantly 0 V. If the operation of the operational amplifier 14 is not normal, the same is made to be constant which is the forward-directional voltage of the diode. That is, the impedance of the detection circuit viewed from the low-potential side of the capacitor 9 is extremely low. The foregoing operation reduces the impedance of the circuit without deterioration in the current/voltage conversion characteristic (the detectable sensitivity) of the ionic current. As a result, the durable amount against the erroneous operation occurring due to the stray capacitance and the impedance of the circuit can be improved significantly.

Specifically, as compared with the conventional degree of occurrence of erroneous operations which have taken place if the stray capacitance is about 200 pF (picofarad), the operation can be performed if the capacitance is about 2000 pF while maintaining a similar detectable sensitivity. Thus, a satisfactory large operational margin can be obtained with respect to the stray capacitance that takes place practically.

However, the apparatus for detecting a misfire in an internal combustion engine shown in FIG. 8 has the following problem.

That is, since the capacitor 9 for detecting the ionic current is charged with electric currents supplied from the primary coil 1*a* of the ignition coil 1, the capacitor 9 is electrically charged regardless of the ignition of the secondary side. Therefore, when the spark plug 2*a* discharges electricity, the ionic current can be detected. Thus, an erroneous detection is sometimes performed due to the change in the discharging voltage on the secondary side.

SUMMARY OF THE INVENTION

In view of the foregoing, an object of the present invention is to provide an apparatus for detecting a misfire in an internal combustion engine capable of preventing erroneous detection in a period in which the voltage discharged on the secondary side of the ignition coil is changed so as to accurately perform misfire detection.

To achieve the foregoing object, according to the present invention, there is provided an apparatus for detecting a misfire in an internal combustion engine, comprising:

an ignition coil having a primary coil, to an end of which a power source is connected and to another end of which a switching device, which is controlled so as to be switched at the ignition timing of the internal combustion engine, is connected;

a spark plug connected to a secondary coil side of the ignition coil to generate discharge in a combustion chamber of the internal combustion engine when applied with high voltage to ignite mixture;

a misfire detection circuit having a capacitor which is supplied with bias voltage from the primary coil of the ignition coil to be electrically charged, which applies the charged voltage to the spark plug so as to cause an ionic current to flow, a first diode connected between a low-potential side of the capacitor and an earth in a direction in which a charging electric current is supplied to the capacitor, a second diode connected in a direction in which the ionic current flows from the capacitor, a charging-voltage setting Zener diode connected between a high-potential side of the capacitor and the earth to set charging voltage into the capacitor, and an operational amplifier having an inverting input terminal adjacent to the low-potential side of the capacitor, a non-inverting input terminal which is the earth, and a feedback resistor connected between the inverting input terminal and an output terminal, the misfire detection circuit being arranged to discriminate whether or not a misfire has taken place in accordance with detection of the ionic current; and a discharge-period detecting portion which prevents transmission of output from the operational amplifier in a period in which the spark plug discharges electricity so as to prevent erroneous detection performed by the misfire detection circuit.

Since the apparatus for detecting a misfire in an internal combustion engine according to the present invention has the foregoing discharge-period detecting portion, erroneous detection of a misfire is prevented in a period in which the discharging voltage is changed so as to improve the accuracy.

DESCRIPTION OF THE PREFERRED EMBODIMENTS

First Embodiment

An embodiment of the present invention will now be described with reference to the drawings.

Figure 1:
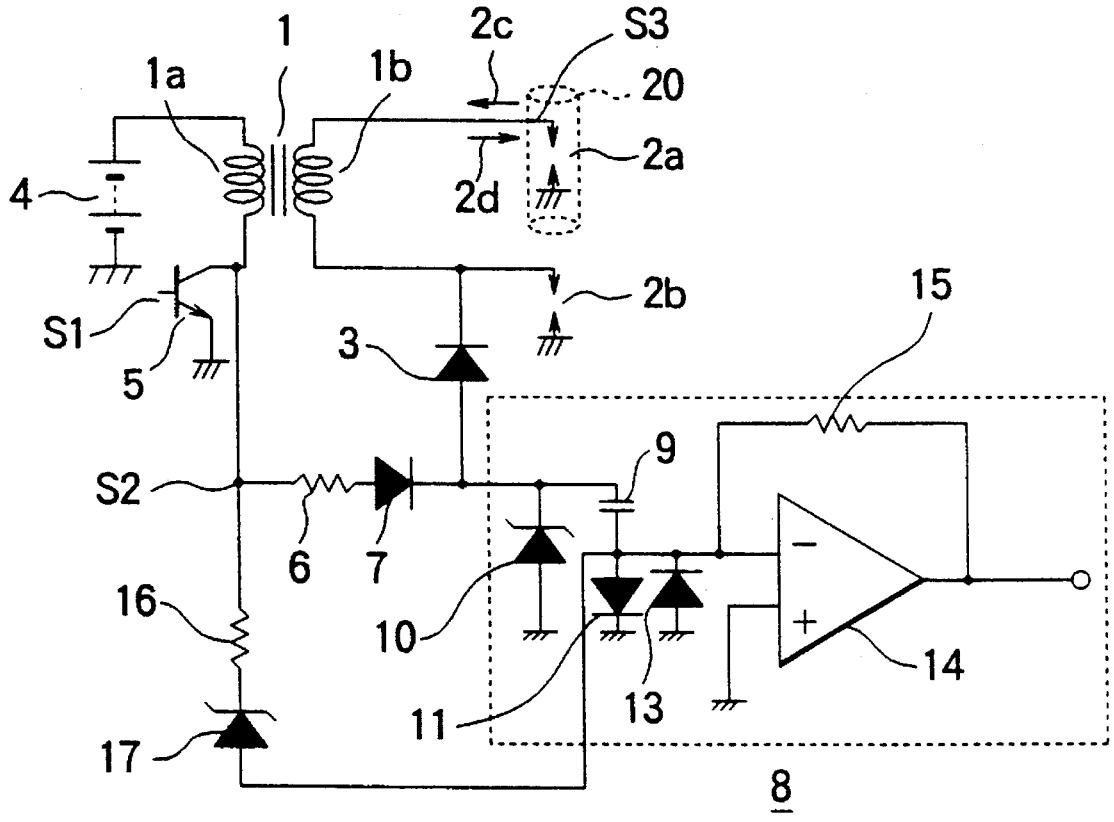
FIG. 1 is a circuit diagram showing the structure of an apparatus for detecting a misfire in an internal combustion engine according to a first embodiment of the present invention.

FIG. 1 is a circuit diagram showing an apparatus for detecting a misfire in an internal combustion engine according to a first embodiment of the present invention.

Figure 8:
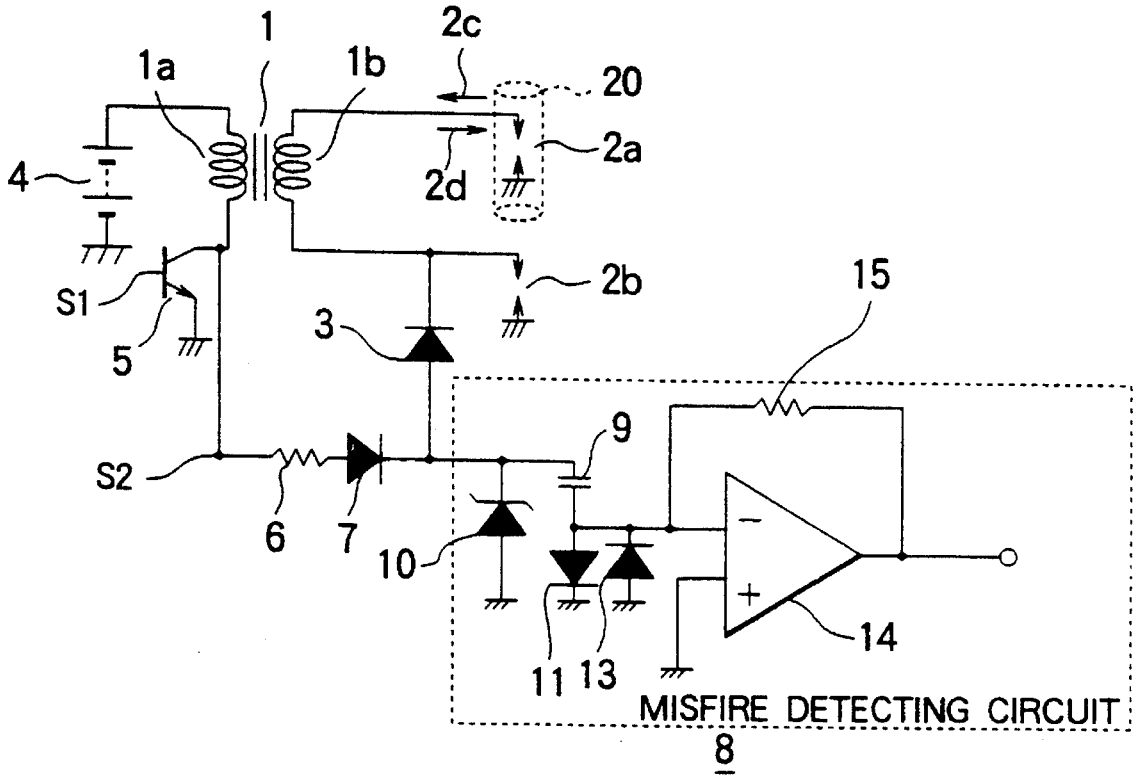
FIG. 8 is a circuit diagram showing an apparatus for detecting a misfire in an internal combustion engine for preventing erroneous detection occurring due to influence of stray capacitance.
Figure 9:
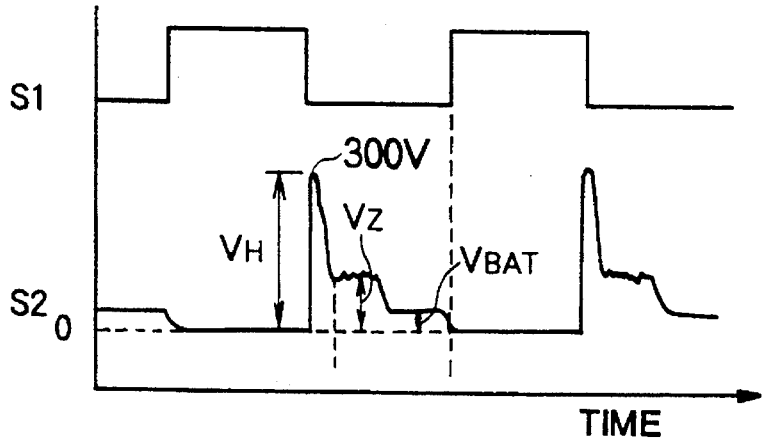
FIG. 9 shows waveforms of respective portions for describing the operation of the circuit shown in FIG. 8.

Referring to FIG. 1, reference numerals 1 to 11 and 13 to 15 represent the same elements as those of the apparatus for detecting a misfire in an internal combustion engine shown in FIG. 8. Reference numeral 1 represents an ignition coil comprising a primary coil having a positive side to which a power source 4 is connected. A transistor 5, which is switched at the ignition timing of the internal combustion engine, is connected to the negative side of the primary coil. Reference numerals 1*a* and 1*b* respectively represent the primary coil and a secondary coil of the ignition coil 1. Reference numerals 2*a* and 2*b* respectively represent spark plugs of a simultaneous ignition type that ignite electric sparks by using high voltages generated on the negative and positive sides of the secondary coil 1*b* of the ignition coil 1. Reference numeral 3 represents a voltage-resistible diode for detecting an ionic current, the voltage-resistible diode 3 having a cathode connected to the spark plug 2*b* and an anode connected to the positive side of the capacitor 9 in the misfire detection circuit 8. Reference numeral 4 represents a power source, and 5 represents a transistor, the collector of which is connected to the negative side of the primary coil 1*a* of the ignition coil 1, the emitter of which is connected to ground, and the base of which is controlled by a control unit (not shown) for controlling combustion, the transistor 5 serving as an electric current switching device. Reference numerals 6 and 7 respectively represent a resistor and a high-voltage diode forming a series body connected to the negative side of the primary coil 1*a* of the ignition coil 1. Thus, a positive bias is supplied from the primary coil 1*a* of the ignition coil 1 to the capacitor 9 of the misfire detection circuit 8. Reference numeral 20 represents a combustion chamber.

Reference numeral 8 represents a misfire detection circuit for determining whether or not a misfire has taken place in accordance with detection of an ionic current flowing out from the capacitor 9 to be described later. Reference numeral 9 represents the capacitor connected to the negative side of the primary coil 1*a* through the resistor 6 and the diode 7 and connected to the positive side of the secondary coil 1*b* through the voltage-resistible diode 3 to receive bias voltage from the primary coil 1*a* so as to be electrically charged. When the spark plugs discharge electricity, the capacitor 9 applies the charged voltage to the spark plugs to cause an ionic current to flow in the secondary side of the ignition coil 1. Reference numeral 10 represents a Zener diode for setting the charging voltage of, for example, a Zener diode $V_Z$ of 50 V, the Zener diode 10 being connected between the high potential side of the capacitor 9 and ground to set the voltage to be charged into the capacitor 9. Reference numeral 11 represents a first diode connected between the low-potential side of the capacitor 9 and ground in a direction in which the charging electric current is supplied to the capacitor 9, the first diode 11 being connected in such a manner that its anode is disposed adjacent to the low-potential side of the capacitor 9. Reference numeral 13 represents a second diode connected between the low-potential side of the capacitor 9 and ground in a direction in which the ionic current flows out, the second diode 13 being connected in such a manner that its cathode is disposed adjacent to the low-potential side of the capacitor 9. Reference numeral 14 represents an operational,amplifier having an inverting input terminal connected to the low-potential side of the capacitor 9, a non-inverting input terminal connected to the earth and a feedback resistor 15 connected between the inverting input terminal and the output.

New reference numeral 16 represents a resistor connected to the negative side of the primary coil 1*a* of the ignition coil 1. Reference numeral 17 represents a discharge-period detecting Zener diode disposed between another end of the resistor 16 and the inverting input terminal (the low-potential side of the capacitor 9) of the operational amplifier 14, the Zener diode 17 having Zener voltage that clamps, at about 20 to 30 V, which is lower than the Zener voltage of the Zener diode 10 for setting the charging voltage. The discharge-period detecting Zener diode 17 is connected in a direction in which the electric current flowing over the Zener voltage is caused to flow toward the invertse input terminal of the operational amplifier 14. The resistor 16 and the Zener diode 17 form a secondary-side discharge-period detecting portion that prevents transmission of the output from the operational amplifier 14 in a period in which the spark plugs discharge electricity to prevent erroneous detection of a misfire performed by the misfire detection circuit 8.

The operation of the circuit shown in FIG. 1 will now be described with reference to waveforms shown in FIG. 2.

Figure 2:
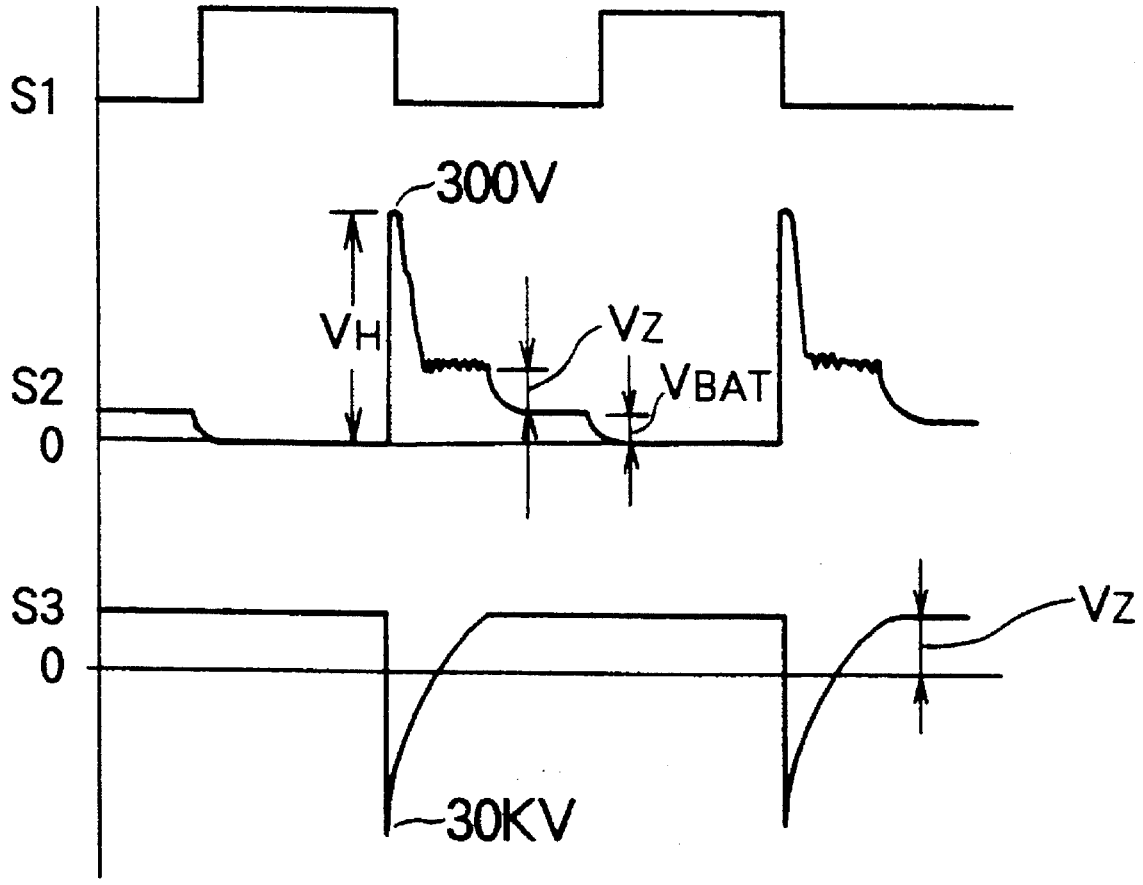
FIG. 2 shows waveforms of respective portions for describing the operation of the circuit shown in FIG. 1.

FIG. 2 shows waveforms of the portions S1 to S3 of the circuit shown in FIG. 1 in which S1 represents the base potential of the transistor 5 which controls the electric current on the primary side of ignition coil 1, S2 represents the potential at the negative terminal of the primary coil 1*a* of the ignition coil 1 and S3 represents the potential at the connected end of the spark plug 2*a* connected to the negative terminal of the secondary coil 1*b* of the ignition coil 1.

The transistor 5 is turned on in an ON period in which an electric current is caused to flow through the primary coil 1*a* and turned off in an OFF period in which the electric current flowing through the primary coil 1*a* is stopped. When the transistor 5, which has been turned on, is turned off, the counter electromotive force of the coil raises the voltage at S2, which is the negative terminal of the primary coil 1*a*, to about $V_H$=300 V. The voltage is the same as the resistible voltage between the collector and the emitter of the transistor 5. At this time, an electric current flows in the capacitor 9 through the resistor 6 and the diode 7 so that the capacitor 9 is charged to about voltage $V_2$ limited by the Zener diode 10.

High voltage generated at S2 is amplified in accordance with the coil ratio between the primary coil 1*a* and the secondary coil 1*b* of the ignition coil 1. Thus, the potential at the connected end S3 of the spark plug 2*a* connected to the negative terminal of the secondary coil 1*b* is raised to about 30 KV so that a spark is generated at the spark plug 2*a*, causing discharge to take place. Thus, the mixture in the combustion chamber 20 is ignited. During the discharge period above, voltage $V_Z$ substantially limited by the Zener diode 10 is maintained in the capacitor 9 so that igniting high voltage $V_H$ at S2 is rapidly lowered to substantially reach voltage $V_Z$ limited by the Zener diode 10. As a result, the voltage at S3 is lowered, causing the electric current flowing in the direction indicated by an arrow 2*c* to be decreased to zero. Thus, a state is realized in which the voltage Vz maintained in the capacitor 9 is applied to the spark plug 2*a*, thus enabling an ionic current to flow in a direction indicated by an arrow 2*d*.

Since the ionic current can be detected during the period in which discharge takes place on the secondary side, there is a possibility that erroneous detection takes place due to the change in the discharging voltage on the secondary side. However, in the circuit shown in FIG. 1, the voltage on the negative side of the primary coil 1*a*, that is, the voltage at S2, is substantially Zener voltage Vz=50 V of the Zener diode 10, the voltage exceeding the Zener voltage of the Zener diode 17. Therefore, a Zener current flows through the resistor 16 and reaches the inverting input terminal side (the low-potential side of the capacitor 9) of the operational amplifier 14. As a result, the operational amplifier 14 does not transmit any output during the period in which the secondary side discharges electricity. Thus, detection of the ionic current is prevented during the period in which the secondary side discharges electricity so that erroneous detection performed by the misfire detection circuit 8 is prevented.

As a result, since erroneous detection can be prevented during the period in which the discharging voltage on the secondary side is Changed, an apparatus for detecting a misfire in an internal combustion engine exhibiting excellent accuracy can be obtained.

That is, the apparatus for detecting a misfire in an internal combustion engine comprising the misfire detection circuit including a capacitor that is charged from the primary side regardless of ignition on the secondary side has the structure in which the discharge-period detecting portion is provided that prevents transmission of output from the operational amplifier in the misfire detection circuit in a period in which the spark plug performs discharge. Therefore, erroneous detection of misfire can be prevented during a period in which the discharging voltage is changed. Thus, an effect can be obtained in that an apparatus for detecting a misfire in an internal combustion engine can be obtained which is able to prevent erroneous detection of a misfire during changing in the discharging voltage and which exhibits excellent accuracy.

In particular, the discharge-period detecting Zener diode is provided to serve as the foregoing discharge-period detecting portion disposed between the other end of the primary coil and the inverse input terminal of the operational amplifier, the discharge-period detecting Zener diode having Zener voltage lower than the Zener voltage of the charging-voltage setting Zener diode. The discharge-period detecting Zener diode is connected such that the electric current flowing while exceeding the Zener voltage flows toward the inverting input terminal of the operational amplifier. As a result, detection of the ionic current is prevented during the discharging period so that erroneous detection performed by the misfire detection circuit is prevented. Thus, erroneous detection can be prevented in a period in which the discharging voltage is changed.

Second Embodiment

Figure 3:
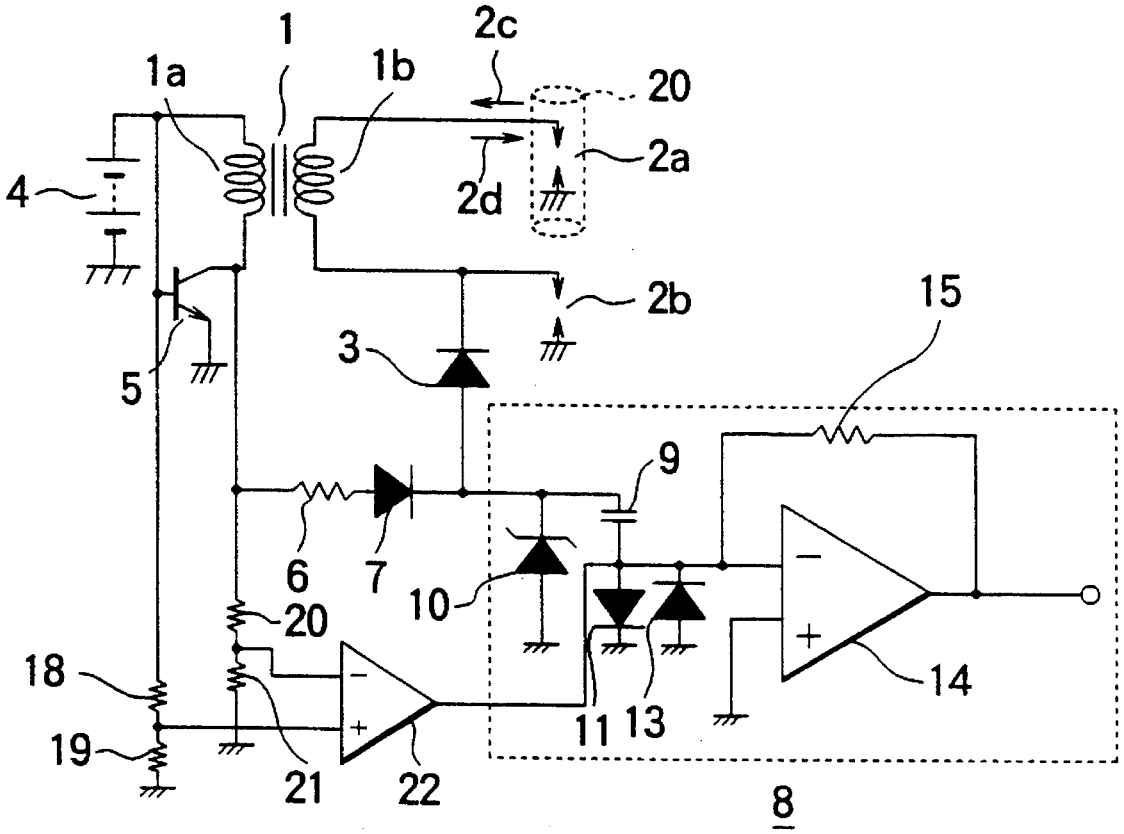
FIG. 3 is a circuit diagram showing the structure of an apparatus for detecting a misfire in an internal combustion engine according to a second embodiment of the present invention.

FIG. 3 is a circuit diagram showing an apparatus for detecting a misfire in an internal combustion engine according to a second embodiment of the present invention. Referring to FIG. 3, reference numerals 1 to 11 and 13 to 15 represent the same elements as those according to the first embodiment and their description is omitted here. New reference numerals 18 and 19 represent power-supply-voltage dividing resistors connected between the power source 4 and ground so as to divide the power-supply voltage of the power source 4. Reference numerals 20 and 21 represent primary-side-voltage dividing resistors connected between the negative terminal of the primary coil 1*a* of the ignition coil 1 and the earth to divide the voltage on the primary side. Reference numeral 22 represents a comparator for subjecting the power supply voltage and the voltage on the primary side to a comparison in accordance with the input of the voltage divided by each of the voltage dividing resistors to transmit a high-level signal if the voltage on the primary side is higher than the power supply voltage. The foregoing voltage dividing resistors 18 to 21 and the comparator 22 form a secondary-side discharge-period detecting portion to prevent transmission of output from the operational amplifier 14 in the period in which the spark plug discharges electricity to prevent erroneous detection performed by the misfire detection circuit 8.

In the above-described circuit, in a period in which the negative terminal voltage of the primary coil 1*a* is higher than the power supply voltage VBAT, that is, in the discharge period for the secondary side, the level of the output from the comparator 22 is raised and a high-level signal is supplied to the inverting input side of the operational amplifier 14. As a result, the output from the operational amplifier 14 is not transmitted, so that detection of the ionic current is prevented during the discharge period for the secondary side. Thus, erroneous detection performed by the misfire detection circuit 8 is prevented. Therefore, a similar effect to that obtainable from the first embodiment can be obtained.

The circuit according to the second embodiment is structured in such a manner that the discharge-period detecting portion is composed of the resistors and the comparator without the Zener diode that is employed in the first embodiment. Therefore, in a case where the misfire detection circuit 8 is composed of a monolithic IC, the discharge-period detection portion can be formed integrally in the monolithic IC. That is, the Zener voltage (20 V to 30 V) of the discharge-period detecting Zener diode 17 in the discharge-period detecting portion according to the first embodiment is different from the Zener voltage (50 V) of the charging voltage setting Zener diode 10 in the misfire detection circuit 8. Therefore, in a case where the misfire detection circuit 8 is composed of the monolithic IC, the first embodiment suffers from unsatisfactorily small voltage resistible margin, thus necessitating providing the discharge-period detecting portion from outside. According to the second embodiment, in a case where the misfire detection circuit 8 is composed of a monolithic IC, the discharge-period detecting portion can be integrally formed in the monolithic IC. Thus, a significant effect can be obtained in installation.

That is, the comparator serving as the discharge-period detecting portion is provided which subjects the voltage on the primary side generated in the primary coil and the power supply voltage of the power source to a comparison to supply a high-level signal to the inverting input terminal of the operational amplifier if the voltage on the primary side is higher than the power supply voltage. Thus, occurrence of the problem of the voltage resistible margin can be prevented in the case where the misfire detection circuit is composed of the monolithic IC. Therefore, the discharge-period detecting portion can be formed integrally in the monolithic IC. As a result, a significant effect can be obtained in installation.

Third Embodiment

Figure 4:
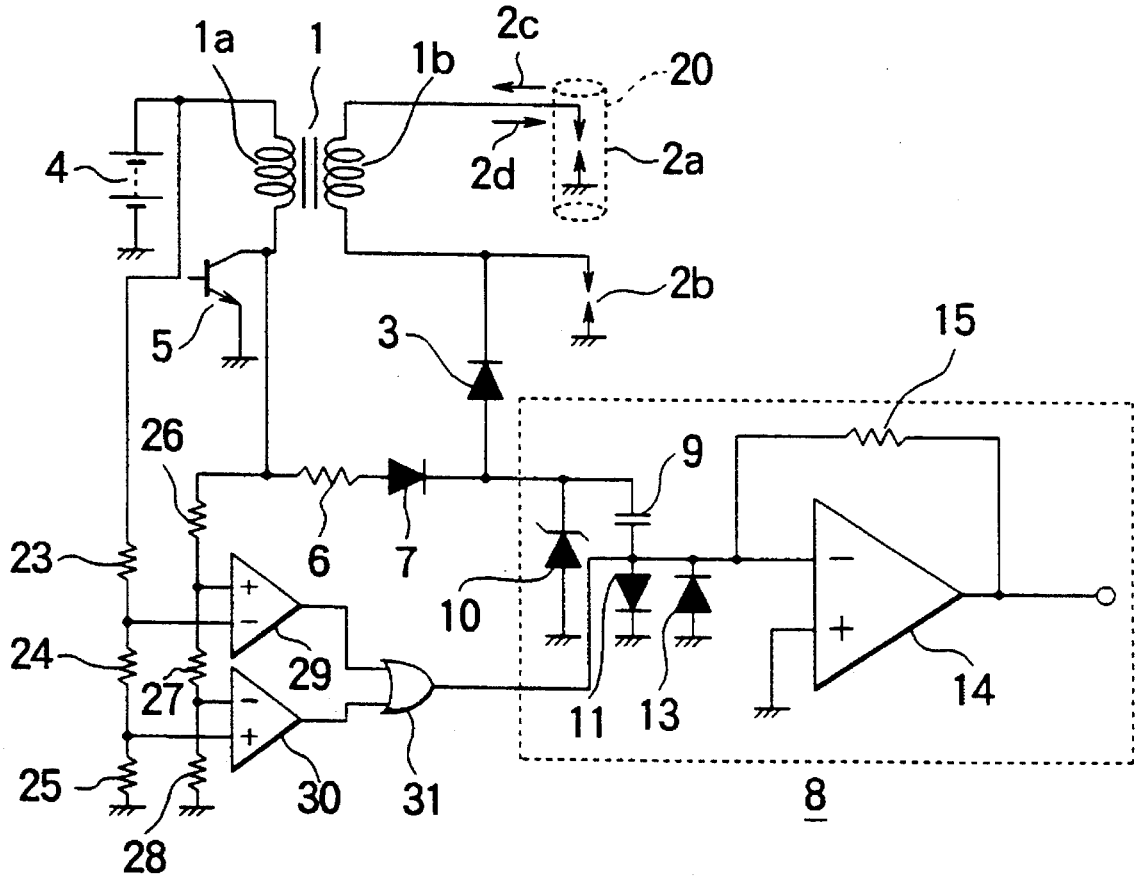
FIG. 4 is a circuit diagram showing the structure of an apparatus for detecting a misfire in an internal combustion engine according to a third embodiment of the present invention.

FIG. 4 is a circuit diagram showing an apparatus for detecting a misfire in an internal combustion engine according to a third embodiment of the present invention. Referring to FIG. 4, reference numerals 1 to 11 and 13 to 15 represent the same elements as those according to the first embodiment and their description is omitted here. New reference numerals 23 to 25 represent power-supply-voltage dividing resistors for dividing the power supply voltage of the power source 4. Reference numerals 26 to 28 represent primary-side-voltage dividing resistors for dividing voltage on the primary side. Reference numerals 29 and 30 represent comparators for subjecting the voltage on the primary side divided by the foregoing voltage dividing resistors and the power supply voltage to a comparison to transmits a high-level signal if the voltage on the primary side is higher than the power supply voltage. Reference numeral 31 represents a logical sum device for obtaining the logical sum of the outputs from the comparators 29 and 30 to supply the output representing the obtained logical sum to the inverting input terminal of the operational amplifier 14. The foregoing power-supply-voltage dividing resistors 23 to 25, the primary-side-voltage dividing resistors 26 to 28, the comparators 29 and 30 and the logical sum device 31 form a discharge-period detecting portion for preventing transmission of output from the operational amplifier 14 during the discharge period for the spark plug to prevent erroneous detection of the misfire detection circuit 8.

The above-described circuit has the structure such that even if either of the outputs denoting the result of the comparison from the comparators 29 and 30 is low level and as well as another output is high level, then the high level signal is supplied to the inverting input terminal of the operational amplifier 14. Therefore, the change in the power supply voltage is prevented in a period in which the transistor 5 is turned on and as well as the ionic current is not detected during the discharge. As a result, a detection apparatus exhibiting excellent detectable accuracy can be obtained.

That is, the discharge-period detecting portion has a plurality of primary-side-voltage dividing resistors for dividing primary-side voltage generated in the primary coil into a plurality of voltages, a plurality of power-supply-voltage dividing resistors for dividing power supply voltage of the power source into a plurality of voltages, a plurality of comparators for respectively subjecting the primary-side voltages divided by the voltage dividing resistors and the power supply voltages to a comparison to transmit high-level signals if the primary-side voltage is higher than the power supply voltage, and a logical sum device which obtains the logical sum of outputs from the comparators to supply a logical sum output to the inverting input terminal of the operational amplifier. Therefore, even if either of the outputs denoting the result of the comparison from the comparators is low level and as well as either output is high level, then the high level signal can be supplied to the inverting input terminal of the operational amplifier. As a result, the influence of the change in the power supply voltage is prevented during a period in which the switching device connected to the primary coil and switched at the ignition timing is switched on. Furthermore, detection of the ionic current is not performed during the discharge period. Thus, a detection apparatus exhibiting further excellent detectable accuracy can be obtained.

Fourth Embodiment

Figure 5:
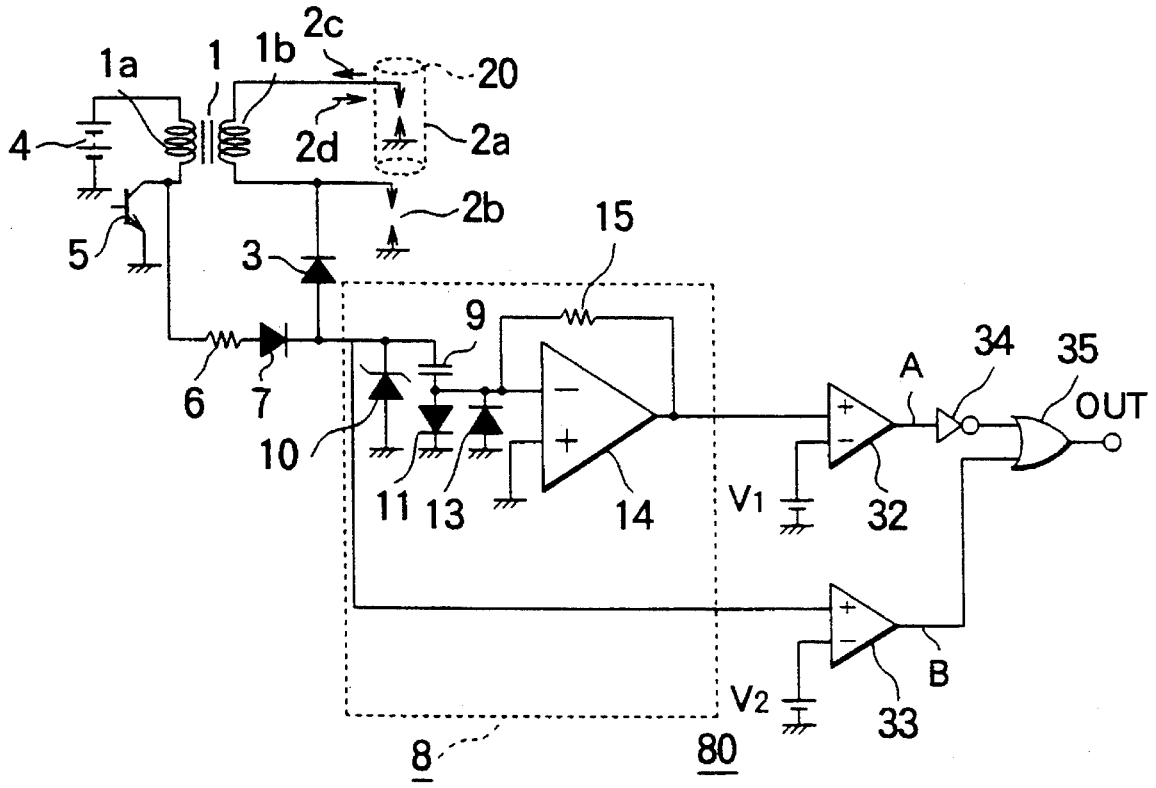
FIG. 5 is a circuit diagram showing the structure of an apparatus for detecting a misfire in an internal combustion engine according to a fourth embodiment of the present invention.

FIG. 5 is a circuit diagram showing an apparatus for detecting a misfire in an internal combustion engine according to a fourth embodiment of the present invention. Referring to FIG. 5, reference numerals 1 to 11 and 13 to 15 represent the same elements as those according to the first embodiment and their description is omitted here. New reference numeral 32 represents a first comparator for subjecting the output from the operational amplifier 14 and first set value $V_1$ (for example, 5 V) to a comparison to transmit a high level signal as output signal A if the output from the operational amplifier 14 is higher than the first set value. Reference numeral 33 represents a second comparator for subjecting the voltage on the high-potential side of the capacitor 9 and second set value (for example, 20 V to 30 V similar to the Zener voltage of the Zener diode 17 according to the first embodiment) to a comparison to transmit a high level signal as output signal B if the voltage on the high-potential side of the capacitor 9 is higher than the second set value. Reference numeral 34 represents an inverter for obtaining an inverse output of the output from the first comparator 32. Reference numeral 35 represents a logical sum device for obtaining the logical sum of the output from the inverter 34 and the output from the second comparator 33. The foregoing first comparator 32, the second comparator 33, the inverter 34 and the logical sum device 35 form a discharge-period detecting portion for preventing transmission of output from the operational amplifier 14 in a period of the discharge of the spark plug to prevent erroneous detection performed by the misfire detection circuit 8.

Figures 6, 7:
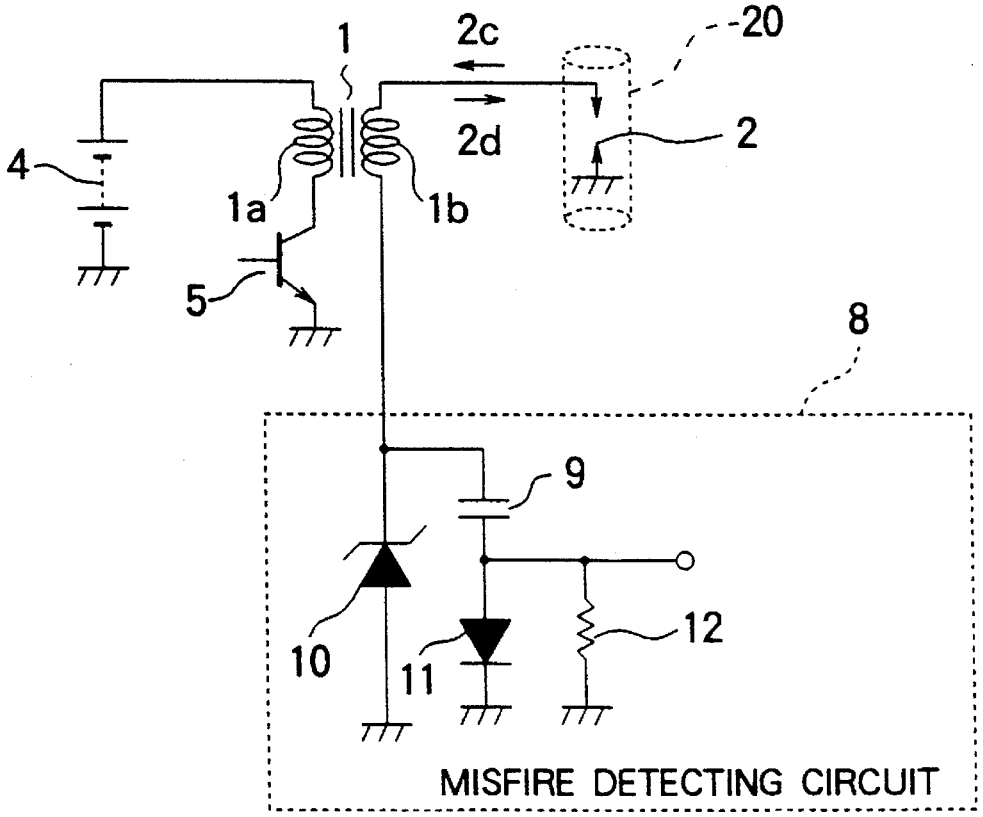
FIG. 7 PRIOR ART
FIG. 6 is a logical value table for use to describe the operation of the circuit shown in FIG. 5.
FIG. 7 is a circuit diagram showing the structure of a conventional apparatus for detecting a misfire in an internal combustion engine.

In the circuit structure shown in FIG. 5, if the level of the output B from the second comparator 33 is high during discharge on the secondary side, the level of output OUT from the logical sum device 35 is raised as indicated in a logical value table shown in FIG. 6 in which the output from the first comparator 32 is indicated by A, that from the second comparator 33 is indicated by B and that from the logical sum device 35 is indicated by OUT. As a result, detection of a misfire is not performed. Thus, erroneous detection of a misfire occurring due to change in the voltage during the discharge period can be prevented. Hence, a detection apparatus exhibiting excellent accuracy can be obtained. Since the circuit structure of the discharge-period detecting portion shown in FIG. 5 is composed of only the comparators and the logical device without a resistor and the like, electricity consumption can be reduced significantly. In a case where the misfire detection circuit is composed of a monolithic IC, the discharge-period detecting portion can easily integrally be formed in the monolithic IC.

That is, the discharge-period detecting portion has a first comparator for subjecting an output from the operational amplifier and a first set value to a comparison to transmit a high-level signal if the output from the operational amplifier is higher than the first set value, a second comparator for subjecting high-potential-side voltage of the capacitor and a second set value to a comparison to transmit a high-level signal if the high-potential-side voltage of the capacitor is higher than the second set value, an inverter for obtaining an inverse output of an output from the first comparator, and a logical sum device for obtaining the logical sum of an output from the inverter and an output from the second comparator. Therefore, the level of the output from the logical sum device is raised if the output from the second comparator is high level during the discharge period. Hence, erroneous detection of a misfire occurring due to change in the voltage during the discharge period can be prevented. Thus, a detection apparatus exhibiting excellent accuracy can be obtained. Since the circuit in the discharge-period detecting portion is composed of only the comparators and the logical device without a resistor and the like, the misfire detection circuit can be composed of a monolithic IC such that the discharge-period detecting portion can easily integrally be formed in the monolithic IC. Furthermore, the electricity consumption can be reduced significantly.

What is claimed is:

1. An apparatus for detecting a misfire in an internal combustion engine, comprising:

an ignition coil having a primary coil, to an end of which a power source is connected and to another end of which a switching device, which is controlled so to be switched at the ignition timing of said internal combustion engine, is connected;

a spark plug connected to a secondary coil side of said ignition coil to generate discharge in a combustion chamber of said internal combustion engine when applied with high voltage to ignite a mixture of fuel and air;

a misfire detection circuit having a capacitor which is supplied with bias voltage from said primary coil of said ignition coil to be electrically charged, which applies the charged voltage to said spark plug at the discharge of said spark plug so as to cause an ionic current to flow, a first diode connected between a low-potential side of said capacitor and ground in a direction in which a charging electric current is supplied to said capacitor, a second diode connected in a direction in which the ionic current flows from said capacitor, a charging voltage setting Zener diode connected between a high-potential side of said capacitor and ground to set charging voltage into said capacitor, and an operational amplifier having an inverting input terminal adjacent to the low-potential side of said capacitor, a non-inverting input terminal which is ground, and a feedback resistor connected between said inverting input terminal and an output terminal, said misfire detection circuit being arranged to discriminate whether or not a misfire has taken place in accordance with detection of the ionic current; and a discharge-period detecting portion which prevents transmission of output from said operational amplifier in a period in which said spark plug discharges electricity so as to prevent erroneous detection performed by said misfire detection current.

2. The apparatus for detecting a misfire in an internal combustion engine according to claim 1 wherein said discharge-period detecting portion has a discharge-period detecting Zener diode disposed between the other end of said primary coil and said inverting input terminal of said operational amplifier, having Zener voltage lower than the Zener voltage of said charging-voltage setting Zener diode, and connected in a direction in which an electric current flowing while exceeding said Zener voltage is caused to flow out toward said inverting input terminal of said operational amplifier.

3. The apparatus for detecting a misfire in an internal combustion engine according to claim 1 wherein said discharge-period detecting portion has a comparator for subjecting voltage on the primary side generated in said primary coil and power supply voltage of said power source to a comparison to supply a high-level signal to said inverting input terminal of said operational amplifier if said voltage on the primary side is higher than said power supply voltage.

4. The apparatus for detecting a misfire in an internal combustion engine according to claim 1 wherein said discharge-period detecting portion has a plurality of primary-side-voltage dividing resistors for dividing primary-side voltage generated in said primary coil into a plurality of voltages, a plurality of power-supply-voltage dividing resistors for dividing power supply voltage of said power source into a plurality of voltages, a plurality of comparators for respectively subjecting the primary-side voltages divided by said voltage dividing resistors and the power supply voltages to a comparison to transmit high-level signals if the primary-side voltage is higher than the power supply voltage, and a logical sum device which obtains the logical sum of outputs from said comparators to supply a logical sum output to said inverting input terminal of said operational amplifier.

5. The apparatus for detecting a misfire in an internal combustion engine according to claim 1 wherein said discharge-period detecting portion has a first comparator for subjecting an output from said operational amplifier and a first set value to a comparison to transmit a high-level signal if the output from said operational amplifier is higher than said first set value, a second comparator for subjecting high-potential-side voltage of said capacitor and a second set value to a comparison to transmit a high-level signal if the high-potential-side voltage is higher than said second set value, an inverter for obtaining an inverse output of an output from said first comparator, and a logical sum device for obtaining the logical sum of an output from said inverter and an output from said second comparator.

6. The apparatus for detecting a misfire in an internal combustion engine according to claim 1 wherein said spark plug consists of spark plugs of a simultaneous ignition type which are respectively disposed on the negative-pole side and the positive-pole side of said secondary coil of said ignition coil to ignite electric sparks by using voltages generated at the respective poles.

7. The apparatus for detecting a misfire in an internal combustion engine according to claim 1 wherein said capacitor is connected in such a manner that its high-potential side is connected to the negative-pole side of said primary coil of said ignition coil through a resistor and a diode, is connected to the positive-pole-side of said secondary coil of said ignition coil through a voltage resistible diode and its low-potential side is connected to ground through said first and second diodes.

8. The apparatus for detecting a misfire in an internal combustion engine according to claim 2 further comprising a resistor disposed between said discharge-period detecting diode and the other end of said primary coil of said ignition coil.

9. The apparatus for detecting a misfire in an internal combustion engine according to claim 3 further comprising a voltage-dividing resistor connected between said power source and ground to divide the power supply voltage and a voltage-dividing resistor connected between the other end of said primary coil of said ignition coil and ground to divide the primary-side voltage, wherein said comparator subjects power supply voltages divided by said voltage-dividing resistors and the primary-side voltage to a comparison.

* * * * *